United States Patent [19]

Harrington et al.

[11] 4,453,471

[45] Jun. 12, 1984

[54] PANEL RETAINING CLAMP FOR COLLAPSIBLE PALLET CONTAINERS

[75] Inventors: James V. Harrington; Edward G. M. Baldwin, both of Calgary, Canada

[73] Assignee: HB Clip-Lok Industries Ltd., Calgary, Canada

[21] Appl. No.: 270,240

[22] Filed: Jun. 4, 1981

[51] Int. Cl.[3] ..... B65D 19/16; B65D 9/12; A44B 21/00

[52] U.S. Cl. ..... 108/55.1; 24/458; 24/457; 108/56.1; 217/12 R; 217/65; 217/69; 24/563

[58] Field of Search ..... 108/56.1, 55.1; 24/259 R, 261 R; 217/12 R, 43 R, 43 A, 65, 69; 206/386, 600; 220/4 F

[56] References Cited

U.S. PATENT DOCUMENTS

| | | | |
|---|---|---|---|
| 2,168,911 | 8/1939 | Meyer . | |
| 2,579,897 | 12/1951 | Blechman . | |
| 2,760,674 | 8/1956 | Karp | 24/259 R X |
| 3,020,988 | 2/1962 | Bransford, Jr. | 24/259 R X |
| 3,082,897 | 3/1963 | Highley | 217/65 |
| 3,323,674 | 6/1967 | Nist, Jr. | 217/12 R |
| 3,599,822 | 8/1971 | Johnson | 217/12 R |
| 3,797,691 | 3/1976 | Williams, Jr. | 220/1.5 |
| 3,822,924 | 7/1974 | Lust | 312/111 |
| 3,949,874 | 4/1976 | Heavner | 206/386 |
| 3,949,929 | 4/1976 | Kupersmit | 206/386 X |
| 3,990,599 | 11/1976 | Rowley | 217/12 R |
| 4,024,977 | 5/1977 | Rowley | 217/12 R |
| 4,083,464 | 4/1978 | Burnett | 217/69 X |
| 4,239,149 | 12/1980 | Kupersmit | 206/600 X |

FOREIGN PATENT DOCUMENTS

| | | | |
|---|---|---|---|
| 147549 | 11/1936 | Austria | 217/12 R |

*Primary Examiner*—William E. Lyddane

*Attorney, Agent, or Firm*—Ziems, Walter & Shannon

[57] ABSTRACT

A pallet container system having strap-like clamping devices to retain five or more rectangular panels in either an erect box-like condition or in a collapsed condition in which the panels are compactly stacked for handling and storage during non-use. The panels are provided with recess formations spaced from each peripheral edge by a common marginal distance related to the combined thickness of five panels. The clamps are preferably L-shaped in configuration to define legs differing in length from each other by the thickness of one panel. In the erect condition, the short leg extends about the edge of one panel and along the surface of another panel oriented at right angles to the one panel so that clamping projections at the ends of the legs engage in the recessed formations. In a collapsed condition, the panels are stacked and the clamp engaged about the edges to retain the panels in an overlying stacked relationship and also to retain a complete set of clamps with the stacked panels. The floor panel of the system is provided with alternately spaced slots so that by selection of either the short or the long leg of the clamps, the number of panels retained by the clamps in a stacked condition may vary between five and six in number.

11 Claims, 14 Drawing Figures

PANEL RETAINING CLAMP FOR COLLAPSIBLE PALLET CONTAINERS

BACKGROUND OF THE INVENTION

This invention relates to reusable shipping containers and more particularly, it concerns a panel retaining clamp arrangement by which five or more rectangular panels of plywood or similar material may be retained in an erect box-like container or in a compact stacked condition for storage or shipment with the full complement of clamping devices needed to effect the erected container.

In the transportation and storage of a wide range of commodities, shipping pallets and pallet containers are used extensively to facilitate handling by fork-lift vehicles, cranes or other such devices during loading or unloading operations. Although simple pallets in which a floor or deck panel is supported on skids or chocks to accommodate the tines of fork-lift devices have in the past and continue to supply the handling needs for shipping and storing many types of goods and materials, pallet containers in which the handled goods are partially or completely enclosed have such obvious advantages as increased capability for stacking and accommodation to predetermined spatial dimensions, not to mention the protection and containment features of an enclosure as distinguished from a simple planar support.

The major drawbacks with pallet containers heretofore available is added cost particularly in the continued handling, storage and transportation of the containers themselves when they are not in use for the transportation or storage of commercial goods. While the initial costs of pallet container manufacture are also significant, such initial costs, at least to the shipping and warehousing industries, are predictable and readily accommodated by the appropriate pricing of shipping and storing services. Empty pallet containers, on the other hand, represent a continuing and widely variable expense to such industries and ultimately to the public at large.

The problems associated with pallet containers have been partially solved by the use of reusable collapsible containers which reduce substantially the storing and shipping space requirements for the empty containers. Prior designs of such reusable and collapsible pallet containers, however, have involved trade-off between relatively high costs incident to satisfaction of such attributes as strength needed for the shipping of heavy or delicate goods and products, accommodation to diverse container sizes, ease of conversion between collapsed and erected states, and durability necessary to stand up under rough handling, as against reduced manufacturing and handling costs resulting in limitations on either the nature of goods capable of shipment, restriction on container size variation, and reduced facility for stacking without damage to or reliability on the contained goods for support of successive stacking tiers. Most collapsible shipping pallet containers tend to favor the latter criteria with the result that reusable pallet containers have enjoyed only limited acceptance and then only with special types of cargo.

There is a need, therefore, for improvements in the field of collapsible pallet containers to provide, without significant added expense, increased ruggedness and strength, adaptability to a wider range of cargos, and increased ease of convertability between erect and collapsed states.

SUMMARY OF THE INVENTION

In accordance with the present invention, a ruggedly simple pallet container system is provided in which a set of unique clamping devices function to retain five or more rectangular panels either in an erect box-like condition or in a collapsed condition in which the panels are compactly stacked for handling and storage during non-use. Each clamping device takes the form of a unitary strap-like member of tempered steel or similar material shaped to define a central bight portion from which a pair of clamping projections are struck out at angles of 90 degrees or less to be received in slot-like grooves or openings in the panels. The clamping devices are primarily embodied in an L-shaped form in which the central bight portion is defined by two legs extending inwardly from the respective clamping projections to a common juncture or bend lying on a line perpendicular to the longitudinal dimension of both legs. The clamping projections are preferably formed as flange-like formations bent at their free ends to present rounded lips. Alternatively, the projections may be in the nature of cylindrical plug-like formations struck out from the strap-like material from which the clamps are made. Additionally, the clamping devices may take a form in which the bight portion is linear for adaptation to joining panels in an end-for-end abutting relationship. In this latter form, the clamping projections are formed as flanges having a central bifurcated anchoring portion to assure retention of the clamping projection in the recess of each panel.

The five or more panels used in the pallet container system are preferably formed of plywood or material having the strength characteristics of plywood and may be of different thicknesses by appropriate dimensional modification of the clamping devices. Of the five or more panels used in a single pallet container, the panel used as the floor or deck is fitted with two or more skids in a manner conventional to simple pallets for accommodation of fork-lift tines or the like. All of the remaining panels are identically formed with slot-like recesses or grooves spaced at the same marginal distance from the edges of the panels, the common marginal distance preferably corresponding to five times the thickness of each panel used in the pallet container. In the L-shaped form of the clamping device, one of the legs of the central bight portion is of a length corresponding to the common marginal distance to the slots whereas the other leg is increased in length by the thickness of one panel. In this way, all panels may be joined at right angles by abutting an edge of one panel against the surface of another panel and the L-shaped clamp applied to retain this assembly of panels by the longer leg extending across the thickness of the other panel and the marginal distance of the slot-like formation in the one panel from its abutting edge. To retain the panels in the collapsed state, one of the legs of the L-shaped clamp is engaged about the underside of the floor panel whereas the other leg spans the thickness of at least five panels so that the clamping projection overlies the top surface of the uppermost panel in the stack. All clamping devices in the set are arranged on opposite sides of the stacked panels to retain them in this condition either for storage or handling. To accommodate a pallet container which may or may not have a cover panel (an arrangement requiring six panels) the floor panel is provided with alternate slot-like formations so as to accommodate either the short or the long leg of the clamping devices leaving the other to span the thickness of either five or six panels.

A primary object of the present invention is to provide a ruggedly simple, reusable pallet container system in which an assembly of rectangular panels may be easily converted between an erect box-like container and a collapsed or stacked assembly of the panels in which all of the components needed for the pallet container are retained for ease of handling and storage. Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENTS

Figure 2:
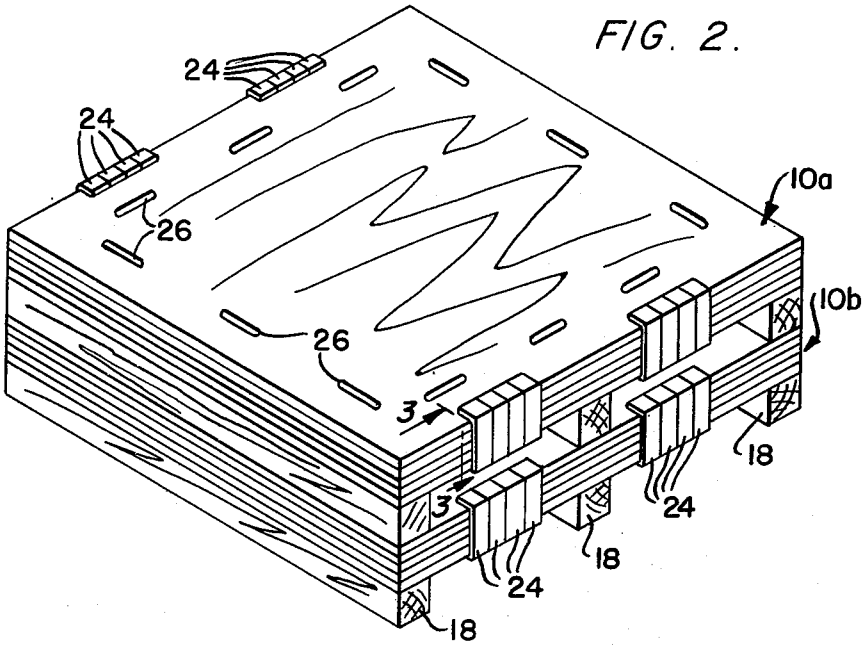
FIG. 2 is a perspective view illustrating the pallet container system in a collapsed condition.

In FIGS. 1–6 of the drawings, components constituting a preferred embodiment of the present invention are shown in a pallet container assembly generally designated by the reference numeral 10. Erect and collapsed conditions of the assembly are illustrated respectively in FIGS. 1 and 2, two such assemblies 10*a* and 10*b* being shown in FIG. 2.

Each assembly 10 is shown to include a rectangular floor panel 12 having side and end edges 14 and 16, respectively. To elevate the floor panels 12 from a surface on which the pallet 10 is supported in accordance with conventional loading pallet practice to accommodate the tines of a fork-lift device, the floor panel 12 is permanently secured such as by bolts (not shown) to at least two skids 18 extending throughout the length of and parallel to the side edges 14 of the floor panel. A pair of side panels 20 and a pair of end panels 22 are adapted to be erected on the floor 12 and secured in the erected condition shown in FIG. 1 by a set of clamps 24 of identical, generally L-shaped configuration, to be described in more detail below.

Figure 1:
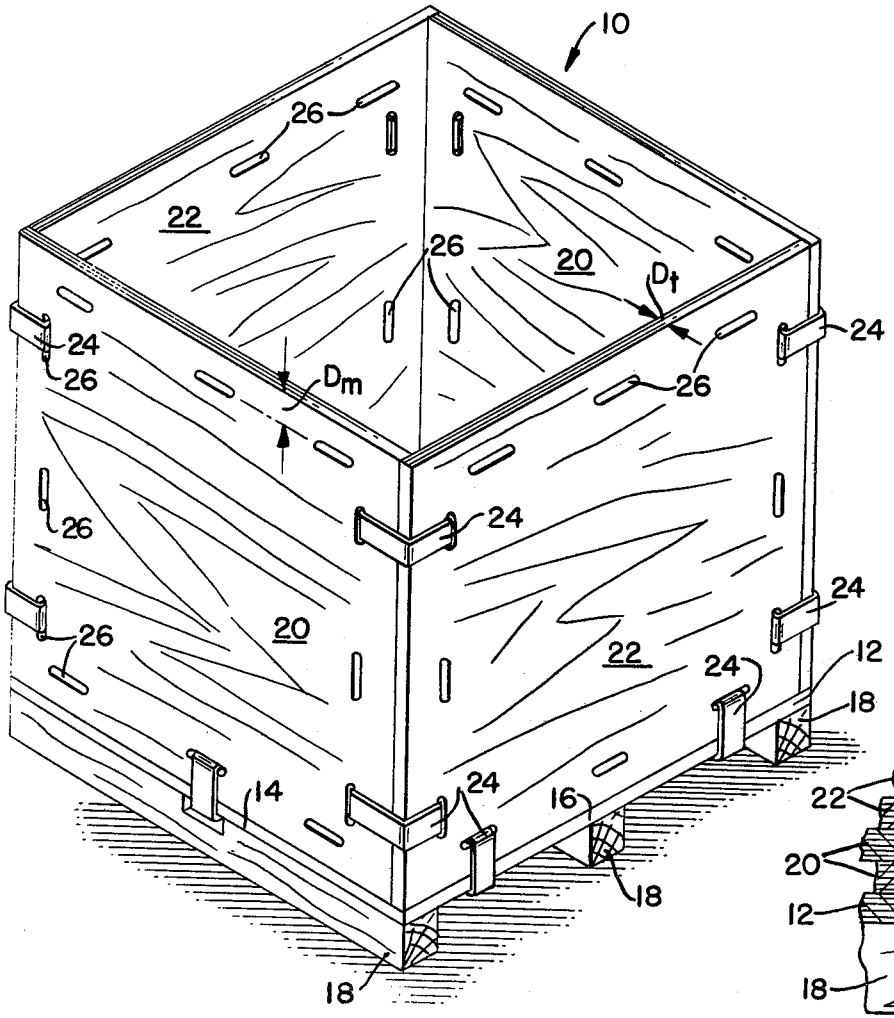
FIG. 1 is a perspective view illustrating a preferred embodiment of the pallet container system of the present invention in an erect condition.
Figure 5:
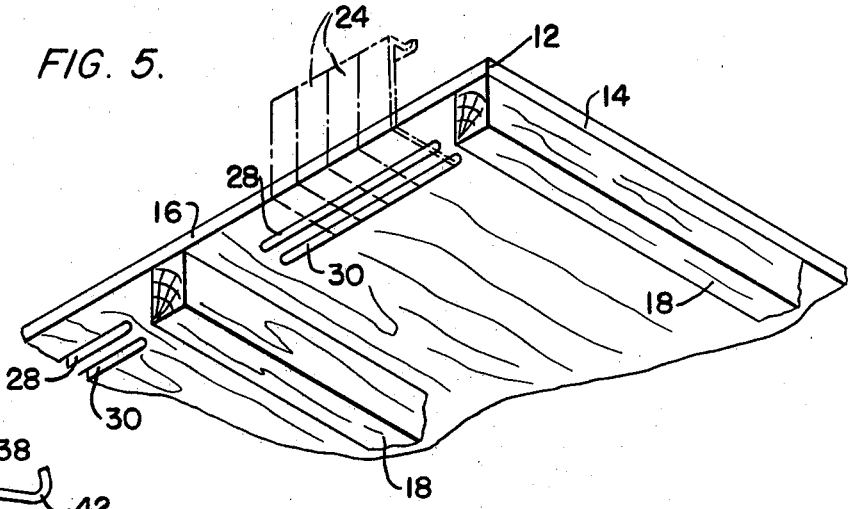
FIG. 5 is a fragmentary bottom perspective view illustrating the deck panel of the pallet container.

Each of the panels 12, 20 and 22 may be characterized as having opposite planar surfaces spaced by the thickness of the panel of the dimension $D_t$ in FIG. 1. While the thickness dimension $D_t$ is selected to provide adequate strength in the panels, it is contemplated that conventional plywood panels $\frac{5}{8}$ inch in thickness or $\frac{3}{4}$ inch in thickness will be used. It is also contemplated, however, that panels of materials other than plywood but having similar characteristics may be used. Also, the length and height of each of the panels 20 and 22 may be varied to accommodate a rectangular parallelepiped of any desired dimensions. Although the height of the panels 20 and 22 is independent of the size of the floor panel 12, the length of the panels 20 and 22 is related to the width and length of the floor panel. Specifically, the length of the panels 20 is equal to the length of the edge 14 of the floor panel minus the common panel thickness $D_t$. The length of the end panels 22 are similarly equated to the length of the floor panel edge 16, again less the common panel thickness $D_t$. Thus, where a cube-like container essentially as illustrated in FIG. 1 of the drawings is desired, the panels 20 and 22 would be of a height equal to the width and length of the floor panel 12 and of a length reduced by the panel thickness as mentioned.

All panels used in the pallet container 10 are provided with at least one slot-like formation 26, the longitudinal centerline of which is spaced inwardly from each linear peripheral edge by a common marginal distance $D_m$. In the embodiment illustrated in FIG. 1, the slot formations 26 extend throughout the thickness of the panels as openings and are of a length slightly in excess of the width of the clamping devices 24. Also it will be noted that each of the side and end panels 20 and 22 are provided with three of the slot formations 26 along each edge or with a total of twelve such openings.

The floor panel 12 is provided with one slot formation along the side edges 14 thereof and which, though not shown in the drawings, is identical to the slots 26. As shown most clearly in FIGS. 3–5, two elongated slot openings 28 are spaced inwardly from the end edges 16 of the floor panel 12 by the distance $D_m$ in the same manner as the slots 26. A second pair of elongated slots 30 are formed in the floor panel 12 to be spaced inwardly from the end edges 16 by a dimension $(D_m+D_t)$ or by the distance $D_m$ plus the thickness of one panel. The reason for this will become apparent from the description to follow below.

Figure 6:
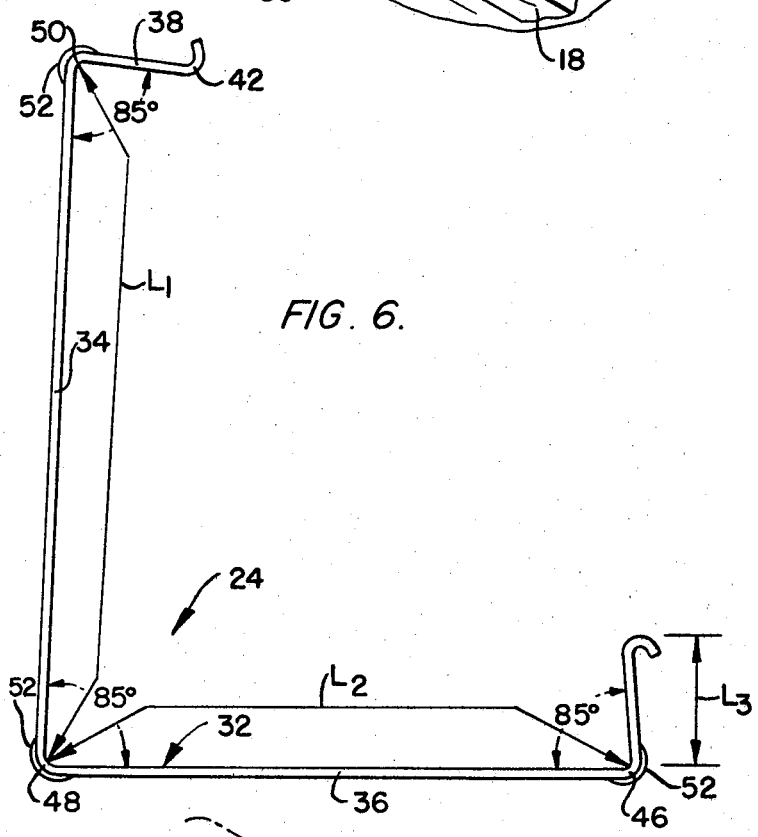
FIG. 6 is a side elevation illustrating a preferred embodiment of a clamping device of the present invention.

Each of the clamps 24 is preferably formed of tempered, low-carbon steel having a thickness of approximately 0.065 inch and a uniform width of approximately 2 inches throughout its length to define a transversely bent strap-like formation in which the side edges lie in spaced parallel planes perpendicular to the lines of bending. While the characteristics of such material having these dimensions are preferred to provide adequate strength for most applications of the clamp 24, it is contemplated that both the thickness and the width of the clamp 24 may vary depending on the size of pallet container in which the clamps are to be used. As shown in FIG. 6, the clamp 24 includes a central bight section 32 which in this instance, is bent transversely to provide an L-shaped configuration defining a pair of legs 34 and 36. At opposite ends of the bight section 32, in this instance the free ends of the legs 34 and 36, a pair of clamping projections 38 and 40 are struck out as flanges having at their free ends, a reverse bend defining curved lips 42 and 44, respectively. The legs 34 and 36 as well as the flanges 38 and 40 may be characterized as linear strap sections joined by parallel transverse bends 46, 48, and 50. Each of the bends thus characterized preferably define a common acute angle which, as illustrated in FIG. 6, approximates 85 degrees. Also it will be noted that each of the bends 46, 48, and 50 are provided with rigidifying embossments 52 to eliminate or minimize flexure at the bends.

In FIG. 6, the lengths of the legs 34 and 36 as well as both clamping projections 38 and 40 are indicated respectively by the dimensions $L_1$, $L_2$, and $L_3$. While these dimensions may vary in practice, they are related to the panel thickness $D_t$ and to the marginal distance $D_m$ between the slots 26 and the peripheral edges of the panels, the latter dimension also being related to the panel thickness $D_t$. In particular, the shorter of the two legs 34 and 36, in this instance the leg 36, is of an inside length $L_2$ corresponding to the dimension $D_m$ which, in turn, is selected to approximate five times the common panel thickness $D_t$. The longer of the two legs, in this instance the leg 34, is of an inside length $L_1$ approximately the sum of the length $L_2$ and the common panel thickness $D_t$. The dimension $L_3$ or the distance the clamping projections 40 project from the inner surface of the central bight section 32 is selected to be not larger than the common panel thickness $D_t$.

To facilitate a complete understanding of the relationship between clamp dimensions and the panel thickness dimension $D_t$, specific examples will be considered. Thus, for a common panel thickness $D_t$ of $\frac{3}{4}$ inch, $L_1=4$ 9/16 inches; $L_2=3$ 13/16 inches; and $L_3=\frac{3}{4}$ inch. The marginal distance of the slots 26 from the respective panel edges or $D_m$ in this example, is $3\frac{3}{4}$ inches where the width of each slot 26 is 5/16 inch. It will be noted that $L_1$ and $L_2$ exceeded by 1/16 inch, the composite thickness of six and five panels, respectively. Also, the marginal distance $D_m$ to the center of the slots 26, is equal to the composite thickness of 5 panels. Because of the slot width, however, the distance between the panel edge and the edge of each slot facing oppositely from the panel edge is 5/32 inch less or 3 19/32 inch, 7/32 inch less than $L_2$.

For a common panel thickness $D_t$ of $\frac{5}{8}$ inch, clamp dimensions are exemplified as follows: $L_1=3$ 13/16 inches; $L_2=3$ 3/16 inches; and $L_3=\frac{5}{8}$ inch. In this instance, the slots 26 are located in the panels so that $D_m=3\frac{1}{8}$ or 5 times the panel thickness $D_t$. In both of the examples given, the clamp structure 24 is of tempered low carbon steel 0.065 inch in thickness and uniformly 2 inches in width. As indicated above, these latter dimensions may be modified for variations in pallet container size of sufficient magnitude that significantly less or significantly greater strength is required in the clamp.

To erect the container assembly 10 as shown in FIG. 1, any two of the panels 20 and 22 are arranged in a vertical orientation at right angles to each other on the floor panel 12 and so that the edge of one of the two panels abuts the inner surface adjacent to the edge of the other panel. One or more of the clamps 24 are then inserted in the appropriate slots 26. In this latter respect, the clamping projection 40 on the leg 36, the shorter of the two legs in the illustrated embodiment, may be placed first into an aperture 26 of the other of the two mentioned panels with the longer leg 34 projecting across and beyond the edge of that panel. The one of the two panels may be then moved outwardly in a perpendicular relationship to the panels so that the clamping projection 38 enters the appropriate slot in that panel. The panels are erected as shown in FIG. 1 wherein opposite joined edges of each panel alternate between abutting closed edges and open or exposed edges. In this way any tendency for temporary inward collapse of the panels is avoided. After the sidewalls are interconnected, they are connected to the floor panel again by inserting the clamps 24 so that the long legs 34 engage in slots 26 in the side panels. To insert these clamps, they are merely pressed inwardly at the corner formed between the side panels and the floor causing the legs 36 and 34 to flex slightly until the clamping projections 38 and 40 snap into the slots 26 in the end and side panels 20 and 22 and into the slots 28 of the floor panels.

With the clamps 24 in place, the erected container as shown in FIG. 1 may be filled with substantially any material either with or without first lining the interior of the container with plastic or otherwise impervious film to confine fluent or finely granular materials. Any tendency for loading by the contents to separate the joined panels will be resisted primarily by tensile strength of the steel clamps and in a way which will augment the overall structural integrity of the loaded pallet container. In this latter respect, outward force or pressure tends to draw the clamps and panels into a firmer and more rigid union.

In FIG. 1 the receptacle is shown to be open at its top. A cover panel having precisely the same dimensions as the floor panel 12 may be added simply by the addition of four or more clamps 24.

Figure 4:
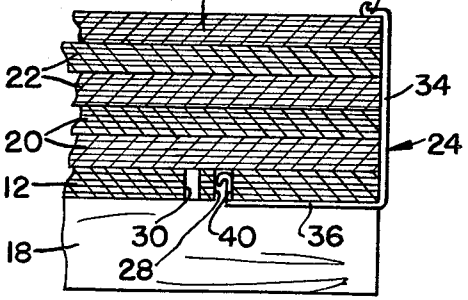
FIG. 4 is a fragmentary cross-section similar to FIG. 3 but illustrating the application of the invention to a pallet container incorporating six panels.
Figure 3:
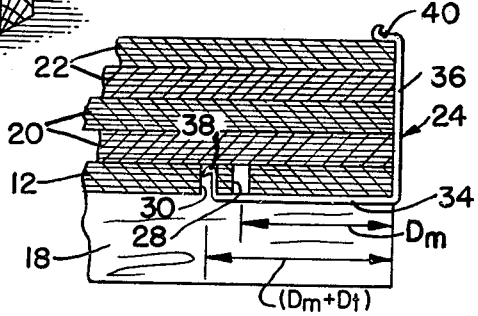
FIG. 3 is an enlarged fragmentary cross-sectional view on line 3—3 of FIG. 2 illustrating the stacked assembly of a pallet container using five panels.

In FIGS. 2–4 of the drawings, the collapsed condition of the pallet container 10 is illustrated. To achieve this condition from the erected condition illustrated in FIG. 1, the clamps 24 are merely removed by prying one of the clamping projections 38 or 40 from the respective slots 26 until the clamp is free. This operation is repeated until all clamps are removed. The panels 20 and 22 are then stacked on the floor panel 12 as shown most clearly in FIG. 3 of the drawings. Once in place, the clamps 24 are again used to retain the panels in the stacked or collapsed condition as shown. In particular, where open topped containers or containers including only five panels are being handled, the long leg 34 of each clamp is inserted into the inwardmost slot 30 in the floor panel 12 and the short leg 36 brought up along the edges of the stacked panels so that the clamping projection 40 engages over the top edge surface of the uppermost panel in the stack.

In FIG. 4, the side and end panels 20 and 22 are shown stacked on the floor panel 12 with the addition of a cover panel 54 to provide a total of six panels. In this instance, the short leg 36 of each clamp 24 is engaged in the outermost slot 28 in the floor panel 12 with the long leg 34 extending upwardly so that the clamping projection 38 engages over the edge of the cover panel 54. Since the addition of a cover panel would require a larger number of clamps, for example, 18 clamps as distinguished from 14 clamps where no cover is used, the slots 28 and 30 in the floor panel 12 are of a sufficient length to accommodate five adjacent clamps each. In this way, all clamps needed for the erect condition of the pallet container 10 will be secured as part of the collapsed container as shown in FIGS. 2–4 and also function to retain the panels in the collapsed or stacked condition.

Figure 7:
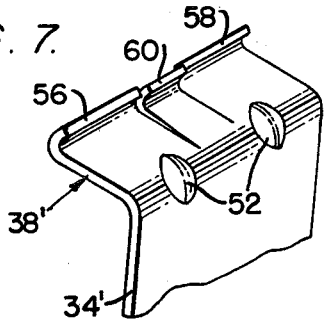
FIG. 7 is a fragmentary perspective view illustrating a modified form of the clamp structure illustrated in FIG. 6.
Figure 8:
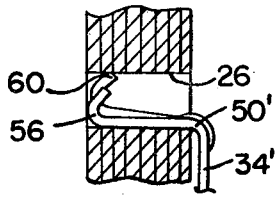
FIG. 8 is a fragmentary cross-section illustrating the modification of FIG. 7 in use.

In FIGS. 7 and 8, a modified embodiment of the clamping projection previously designated by the reference numerals 38 and 40 is shown and designated by the reference numeral 38'. In this instance, a pair of flanges 56 and 58 having the identical cross-sectional configuration of the previously described flanges 38 and 40 are spaced by a tang 60. The tang 60 is formed by cutting the continuous flange and then displacing the tang out of the plane of the flanges 56 and 58 in the direction so as to increase the angle of the tang 60 with respect to the clamp leg 34'. The purpose of the tang 60 is to serve as a retention device to inhibit removal of the clamping projection 38' from the slot 26 as illustrated in FIG. 8. In particular, the tang functions in the manner of a barb which will engage the far side of the slot 26 but may be removed by prying the tang away from that edge for removal of the clamp. The locking arrangement shown in FIGS. 7 and 8 may be used on one or both of the clamping projections 38 and 40 of the clamp shown in FIG. 6. The use of this arrangement on the longer of the two legs 34 would augment retention of the pallet container in its erect condition particularly when empty.

Figure 9:
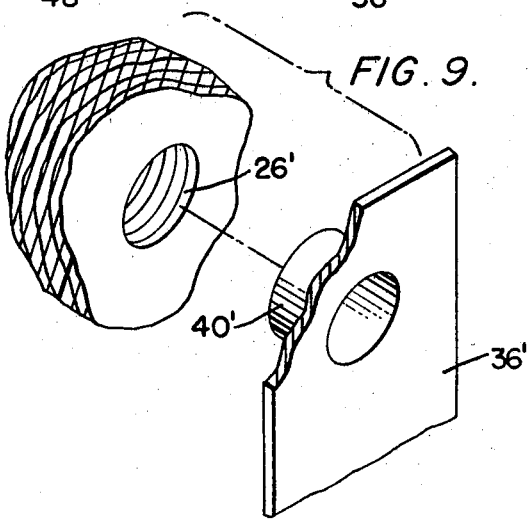
FIG. 9 is an exploded fragmentary perspective view illustrating an alternative embodiment of the invention.
Figure 10:
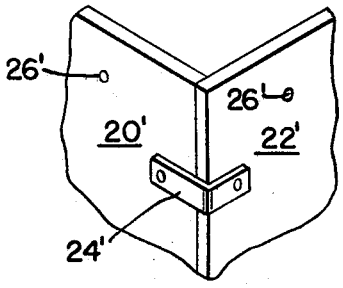
FIG. 10 is a fragmentary perspective view further illustrating the embodiment of FIG. 9.

In FIGS. 9 and 10 a further embodiment of the clamp is shown in which the clamping projections previously identified by the reference numerals 38 and 40 take the form of a cylindrical plug-like formation 40' struck from the metal of the clamp leg 36'. In this instance, the recess formations 26' in the several panels are circular in shape to complement the shape of the cylindrical plugs 40'. In all other respects, the modified clamp 24' of FIGS. 9 and 10 is used in the same manner as the clamp 24 previously described.

Figure 11:
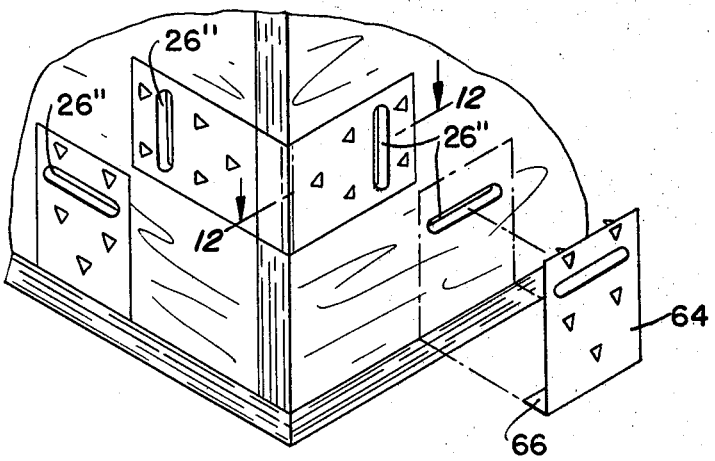
FIG. 11 is a fragmentary perspective view illustrating a reinforcing plate adjunct for use of the present invention.
Figure 12:
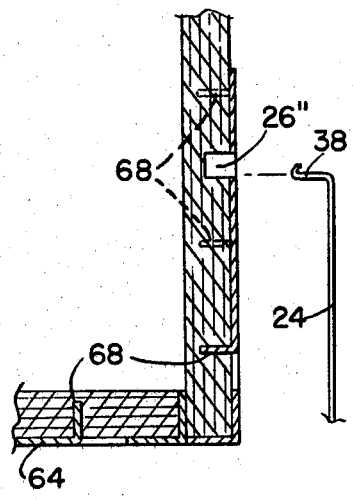
FIG. 12 is a fragmentary cross-section on line 12—12 of FIG. 11.

In FIGS. 11 and 12, a reinforcing plate adjunct 64 is illustrated. Also and as shown in FIG. 12, the slots 26'' for receiving the clamping projections of the clamps 24 are formed as recesses which do not extend all the way through the thickness of the panels. In this latter respect, the clamping projections 38 and 40 are shortened so that where the panel thickness $D_t$ is equal to $\frac{3}{4}$ inch, the length $L_3$ is equal to $\frac{5}{8}$ inch.

The plates 64, as shown, are rectangular plates having a right angle flange 66 to overlie the edge of the panel to which it is applied. The plate is secured by struck out tangs 68 capable of being driven into the respective panels.

Figure 13:
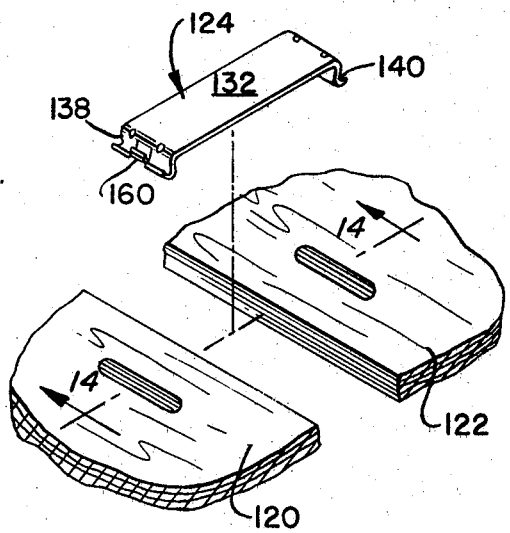
FIG. 13 is an exploded fragmentary perspective view of a further alternative embodiment of the invention.
Figure 14:
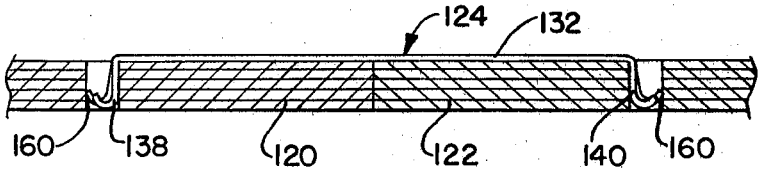
FIG. 14 is an enlarged fragmentary cross-section on line 14—14 of FIG. 13.

In FIGS. 13 and 14 a modified embodiment of a clamp 124 is illustrated. In this embodiment, the bight 132 of the clamp is linear and extends directly between a pair of clamping flanges 138 and 140 preferably having a retention tang 160 as described above with respect to FIGS. 7 and 8. The clamp 124, as suggested in FIGS. 13 and 14 is used to retain two panels 120 and 122 in abutting edge-to-edge relationship. Such as embodiment of the clamp might be used to enlarge the size of pallet container for a given size of the side and end panels 120 and 122.

The present invention therefore results in a versatile pallet container system in which all components needed both for the erect container condition and the collapsed storage condition are extremely simple, rugged, and capable of low-cost mass production. All panels may be pre-cut to size in quantity and formed with slots using well established cutting and routing procedures. The clamps may be bent and formed from severed lengths of continuous strap-like stock material for subsequent heat treatment and painting in quantity. All manufacturing steps are facilitated by pre-established common dimensioning and the avoidance of time consuming tooling adjustment for component production.

Thus, it will be appreciated that as a result of the present invention, a highly effective panel retaining clamp and collapsible pallet container system is provided by which the principal objective, among others, are completely fulfilled. It will also be apparent to those skilled in the art from the preceding description that modifications and/or changes may be made in the embodiments illustrated and described herein without departure from the invention. Accordingly, it is expressly intended that the foregoing description is illustrative of preferred embodiments only, not limiting, and that the true spirit and scope of the present invention be determined by reference to the appended claims.

We claim:

1. A clamp for retaining panels each having opposite planar surfaces spaced by a given common panel thickness and joined by at least one linear edge, each of the panels having recessed formations to define a clamping surface spaced by a common distance to the respective linear edges, said clamping surfaces facing oppositely from the linear edges in each panel, respectively, said clamp comprising a strap-like member of material having the characteristics of tempered steel, said member having generally continuous side edges lying in parallel planes perpendicular to the thickness thereof and including a central bight portion and a pair of clamping flange projections struck out from the ends of said bight portion at acute angles from the bight portion so as to lie in converging planes perpendicular to the planes of said side edges, said clamping flange projections having rounded lips at the free ends thereof spaced from each other by a total distance along said bight portion corresponding to the distance between said clamping surfaces on two panels in which the linear edge of at least one of the two panels is in abutment with the other of said panels, and a locking tang cut from said flange projection and displaced out of the plane of said flange projection to engage a surface of said recessed formations opposite from said clamping surface.

2. The apparatus recited in claim 1, wherein said bight portion includes a transverse bend to define an L-shaped configuration having two legs extending respectively between said bend and said clamping flange projections.

3. A reusable and collapsible pallet container comprising:

at least five rectangular panels of a common panel thickness to define a floor panel and four side panels, each of said panels having at least one recess formation formed therein and spaced from each panel edge by a common marginal distance;

a plurality of clamping devices for retaining said panels, each of said clamping devices comprising an L-shaped bight portion having two legs extending from a common end to a free end, and a clamping projection on the free end of each of said legs extending from the inside surface of each leg so as to converge toward each other, the length of said legs between said common end and said clamping projections, said marginal distance, and said common panel thickness being related so that said panels may be retained in an erect condition oriented in adjoining perpendicular relationship to each other with said clamps engaged in said recess formations so that said bight portion envelopes an external corner formed by two such adjoining panels, or in a collapsed condition in which the panels are arranged in overlying stacked relation with all panels engaged between the clamping projection on one of said legs and the other of said legs.

4. The apparatus recited in claim 3, wherein said legs for each clamp differ in length by the dimension of said common panel thickness.

5. The apparatus recited in claim 4, wherein the length of each of said side panels is shorter than the corresponding edge of said floor panel by the dimension of said common panel thickness.

6. The apparatus recited in claim 4, wherein each two of said panels in the erect condition are joined at right angles by abutting the edge of one of said two panels against the inside surface of the other of said two panels so that the edge of said other panel is exposed at an exterior corner.

7. The apparatus recited in claim 6, wherein the shorter of said two legs in each clamping device extends from the recessed formation in said other of said two panels and the longer of said two legs in each clamping device extends across said exposed edge of said other panel to the recessed formation in said one panel.

8. The apparatus recited in claim 4, wherein said floor panel includes at least two parallel elongated slot-like recesses spaced from each other by the dimension of said common panel thickness, the outermost one of said two elongated slot-like recesses being spaced inwardly from each of opposite edges in said floor panel by said common marginal distance, whereby in the collapsed condition, either five or six panels may be engaged by reversing the position of said differing length legs.

9. The apparatus recited in claim 3, wherein said recessed formations are slot-like openings through said panels.

10. The apparatus recited in claim 3, wherein said recessed formations are slot-like recesses of a depth less than said common panel thickness.

11. The apparatus recited in claim 3, including a reinforcing plate covering each of said panels in the area of said recess formations.

* * * * *